US007426785B2

(12) United States Patent
Ho

(10) Patent No.: US 7,426,785 B2
(45) Date of Patent: Sep. 23, 2008

(54) MULTI TYPE HEAD MOVING SHAVER

(76) Inventor: Tae-Jun Ho, 204-3, Bupyeong-6-ri, Jinjeop-eup, Namyangiu-shi, Gyeonggi-do (KR) 472-864

( * ) Notice: Subject to any disclaimer, the term of this patent is extended or adjusted under 35 U.S.C. 154(b) by 80 days.

(21) Appl. No.: 11/469,980

(22) Filed: Sep. 5, 2006

(65) Prior Publication Data

US 2007/0283565 A1 Dec. 13, 2007

(30) Foreign Application Priority Data

Jun. 8, 2006 (KR) ..... 20-2006-0015331 U

(51) Int. Cl.
*B26B 19/04* (2006.01)

(52) U.S. Cl. ..... 30/43.92; 30/34.1; 30/216; 30/527

(58) Field of Classification Search ..... 30/34.1, 30/43.9, 43.92, 346.51, 527, 532, 216
See application file for complete search history.

(56) References Cited

U.S. PATENT DOCUMENTS 4,930,217 A * 6/1990 Wolf et al. ..... 30/43.92
5,579,581 A * 12/1996 Melton ..... 30/223
6,052,904 A * 4/2000 Wetzel et al. ..... 30/43.92
6,378,210 B1 * 4/2002 Bickford ..... 30/43.92
6,502,312 B2 * 1/2003 Beutel et al. ..... 30/216
7,302,759 B2 * 12/2007 Oh ..... 30/43.92

FOREIGN PATENT DOCUMENTS

| | | |
|---|---|---|
| JP | 55-86490 | 6/1980 |
| JP | 62-227395 | 10/1987 |
| JP | 63-197484 | 8/1988 |
| JP | 10-43443 | 2/1998 |

* cited by examiner

*Primary Examiner*—Hwei-Siu C. Payer
(74) *Attorney, Agent, or Firm*—Snell & Wilmer L.L.P.

(57) ABSTRACT

A multi type head moving shaver is disclosed. The multi type head moving shaver includes a housing provided with an ON/OFF switch and an inserting portion formed at a top of the housing, a connecting rod mounted inside the housing, the connecting rod being driven by a driving motor, a coupling member coupled to the inserting portion, the coupling member pivoting forward and backward, and a cutting head having a block coupled onto the coupling member, the cutting head pivoting together with the coupling member.

5 Claims, 10 Drawing Sheets

MULTI TYPE HEAD MOVING SHAVER

FIELD OF INVENTION

The present invention relates to a shaver, and more particularly to a multi type head moving shaver capable of selectively mounting a shave head for shaving relatively short hair and a trimmer head for shaving relatively long hair, pivoting the shave head and the trimmer head forward and backward for a smooth shaving, and improving portability.

BACKGROUND OF THE INVENTION

A typical shaver comprises a motor mounted in a housing. When power is applied to the motor by manipulating a switch, the driving force of the motor is transmitted to a cutting head through a connecting member connected to a driving shall of the motor. The driving force drives an inner blade formed inside the cutting head to remove the hair from a user's face or body.

Outer blade is formed outside the head. The outer blade is formed in a mesh shape, and is in close contact with the cutting head. When the user puts the outer blade on his face or body to be shaved, the hair is inserted through the holes of the mesh-shaped outer blade and cut by the inner blade which moves reciprocatingly by the motor. By such a manner, the shaving can be performed promptly so that the user's face or body is smooth.

Since the conventional shaver is configured such that the cutting head is formed integrally with the housing, it is useful in shaving relatively short hair like a short beard or a mustache. However, the conventional shaver is not useful in shaving relatively long hair like a long beard. So, the user should purchase an expensive shaver with combined use for shaving short and long hairs.

Further, since the cutting head is fixed to the housing, it is impossible to shave smoothly along the curve of the human face or body. Accordingly, those skilled in the art have attempted to develop improved shavers for solving the above problems.

One of the prior art shavers is disclosed in Japanese Patent Laid-open Publication No. 62-227395. The prior art shaver comprises a cutting head provided with inner and outer blades and a pivot shaft mounted near a top of the cutting head.

The cutting head pivots forward and backward on the pivot shaft so that the inner blade can follow the curved human face or body in diverse shaving directions.

However, since the pivot shaft is located near the top of the cutting head, a distance between the pivot shaft and the outer blade is short. When the outer blade contacts slantedly to the face or body, it may occur that the cutting head cannot pivot with a small pressurizing force. Further, the cutting head cannot absorb the pressure generated by moving over the curve of the face or body, and causes a skin damage and imperfect shaving.

Japanese Patent Laid-open Publication No. 55-86490 discloses a shaver which is constructed so that multiple inner blades are supported by springs to move up and down separately. The inner blades move up and down individually corresponding to the curve of the user's face or body and absorb the pressure occurring in shaving.

However, for the purpose of restraining vibration of the whole cutting head when driving the inner blades, the springs having relatively large rigidities should be used. So, the multiple inner blades cannot follow the curve of the user's face or body with a small pressurizing force. Further, when the outer blade contacts slantedly to the user's face or body, the shaving is performed imperfectly since the cutting head cannot contact perpendicularly to the user's face or body.

Japanese Patent Laid-open Publication No. 63-197484 discloses a shaver which is constructed so that multiple cutting heads can move up and down individually. The cutting heads adjacent to each other are connected by a ring. If one cutting head moves down according to the curve of the user's face or body, the other cutting head moves up.

However, the cutting heads cannot absorb the pressure occurring in shaving. Further, since the cutting heads do not contact perpendicularly to the user's face or body, the shaving is performed imperfectly.

Japanese Patent Laid-open Publication No. 10-43443 discloses a shaver which is constructed so that the cutting head is formed integrally with a motor to move forward and backward, left and right, and up and down.

However, since a supporting point for moving the cutting head is positioned considerably low, it is difficult that the cutting head follows perfectly the curve of the user's face or body.

SUMMARY OF THE INVENTION

Therefore, the present invention has been made in view of the above problems, and it is an object of the present invention to provide a multi type head moving shaver capable of facilitating a process of mounting/demounting a shave head or a trimmer head to/from a housing and selectively mounting the shave head and the trimmer head.

It is another object of the present invention to provide a multi type head moving shaver capable of simplifying a structure and pivoting a shave head or a trimmer head forward and backward to follow a curve of a user's face or body, thereby shaving smoothly and perfectly.

It is yet another object of the present invention to provide a multi type head moving shaver which can be manufactured compactly to improve portability.

In accordance with the present invention, the above and other objects can be accomplished by the provision of a multi type head moving shaver comprising: a housing provided with an ON/OFF switch and an inserting portion formed at a top of the housing; a connecting rod mounted inside the housing, the connecting rod being driven by a driving motor; a coupling member coupled to the inserting portion, the coupling member pivoting forward and backward; and a cutting head having a block coupled onto the coupling member, the cutting head pivoting together with the coupling member.

Preferably, the inserting portion includes an inserting hole formed at a center portion, the connecting rod passing through the inserting hole; supporting shafts formed at left and right sides of the inserting hole; springs provided at the supporting shafts, the springs elastically supporting the coupling member pivoting forward and backward on the supporting shafts; and pivot shafts formed at the left and right sides of the inserting hole, the cutting head pivoting on the pivot shafts.

Preferably, the coupling member includes a through-hole formed at the center portion, the through-hole being located corresponding to the inserting hole of the inserting portion; and a supporting protrusion to which the cutting head is coupled.

Preferably, the block of the cutting head includes concave portions into which the pivot shafts are fitted, and a coupling hole into which the supporting protrusion is fitted.

A shave head is used as the cutting head for shaving relatively short hair.

Preferably, at least one inner blade is provided in the shave head. A trimmer head is used as the cutting head for shaving relatively long hair.

Preferably, the shave head and the trimmer head are mounted selectively to the housing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
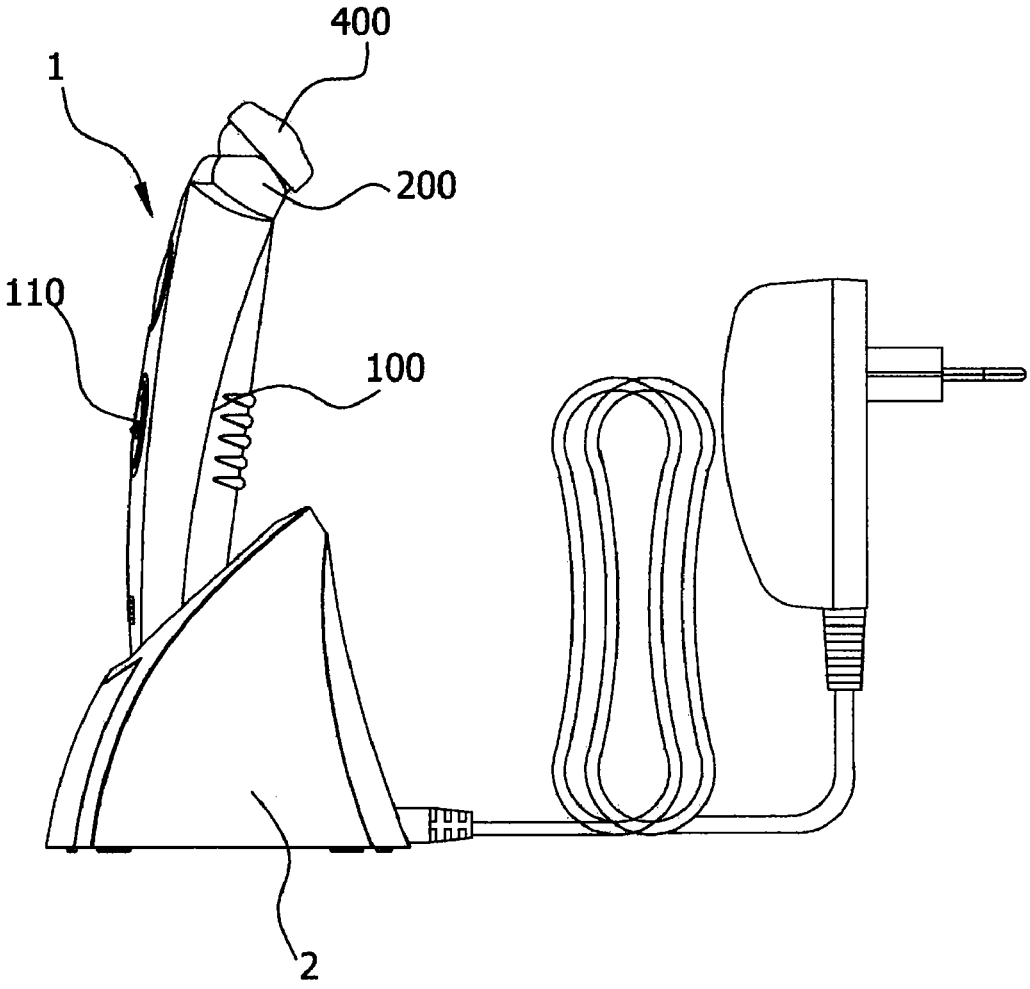
FIG. 1 is a side view showing a multi type head moving shaver in accordance with a preferred embodiment of the present invention.
Figure 2:
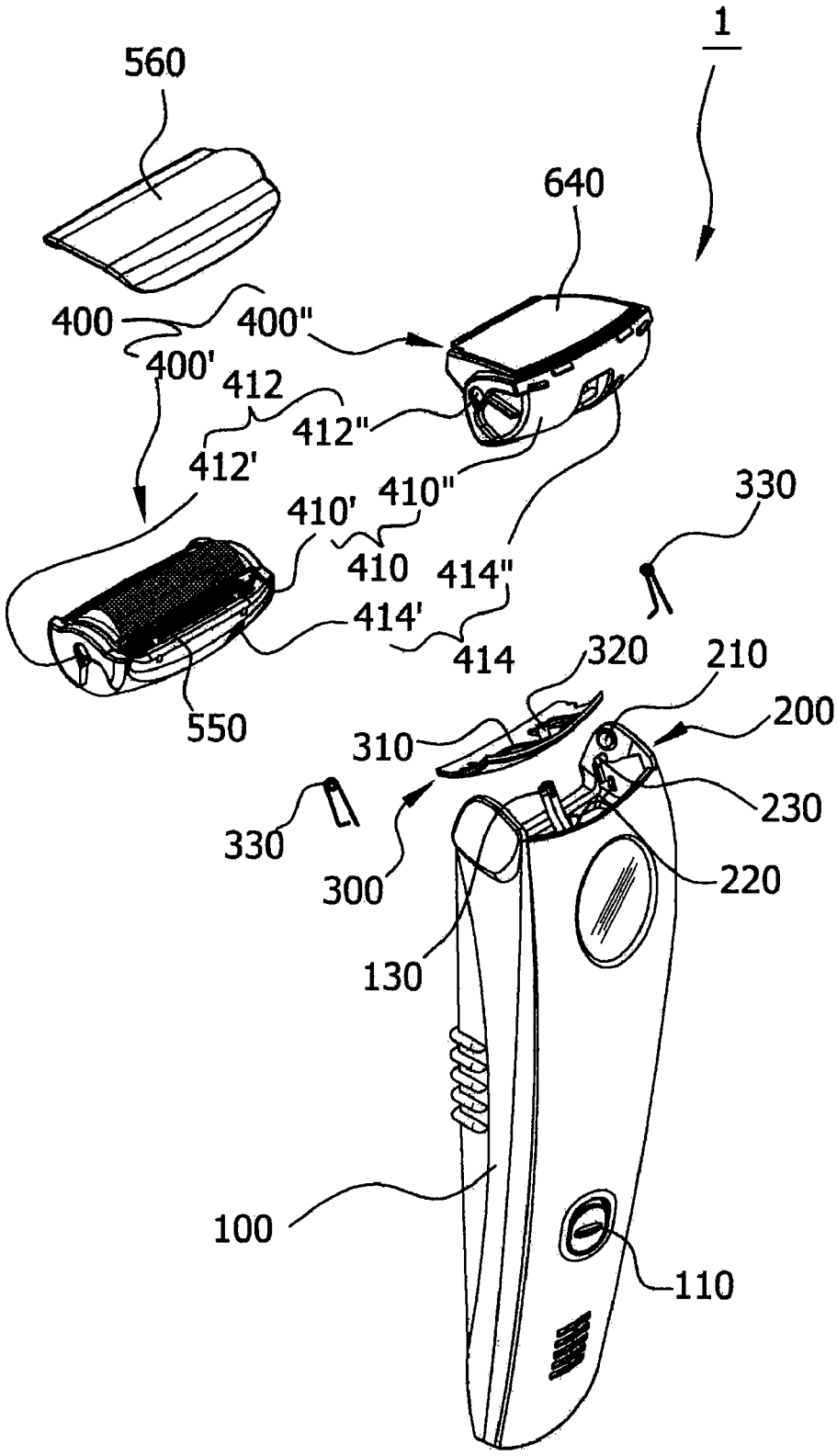
FIG. 2 is an exploded perspective view showing a multi type head moving shaver in accordance with a preferred embodiment of the present invention.
Figure 3:
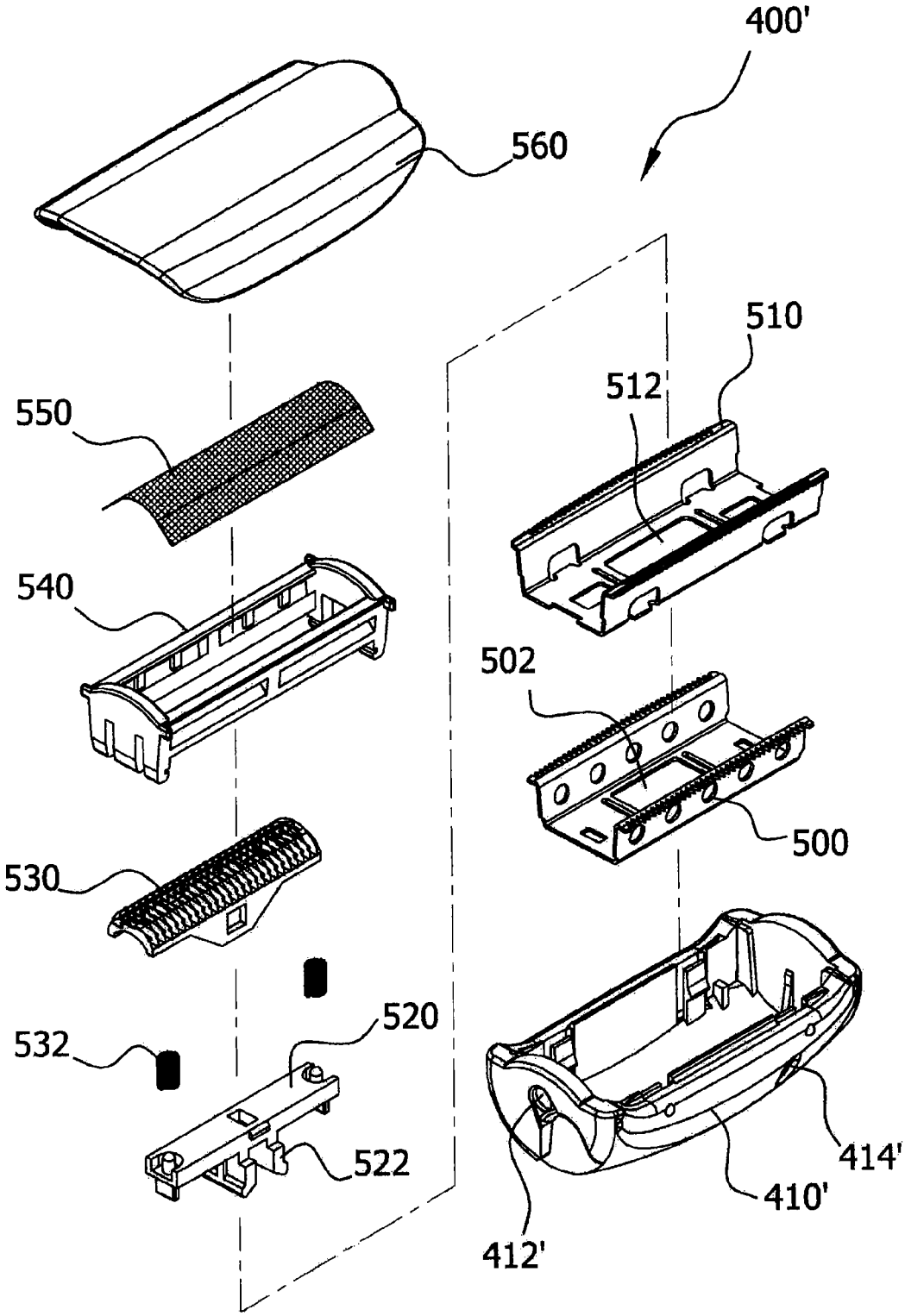
FIG. 3 is an exploded perspective view showing essential components of a preferred embodiment of a shave head.
Figure 4:
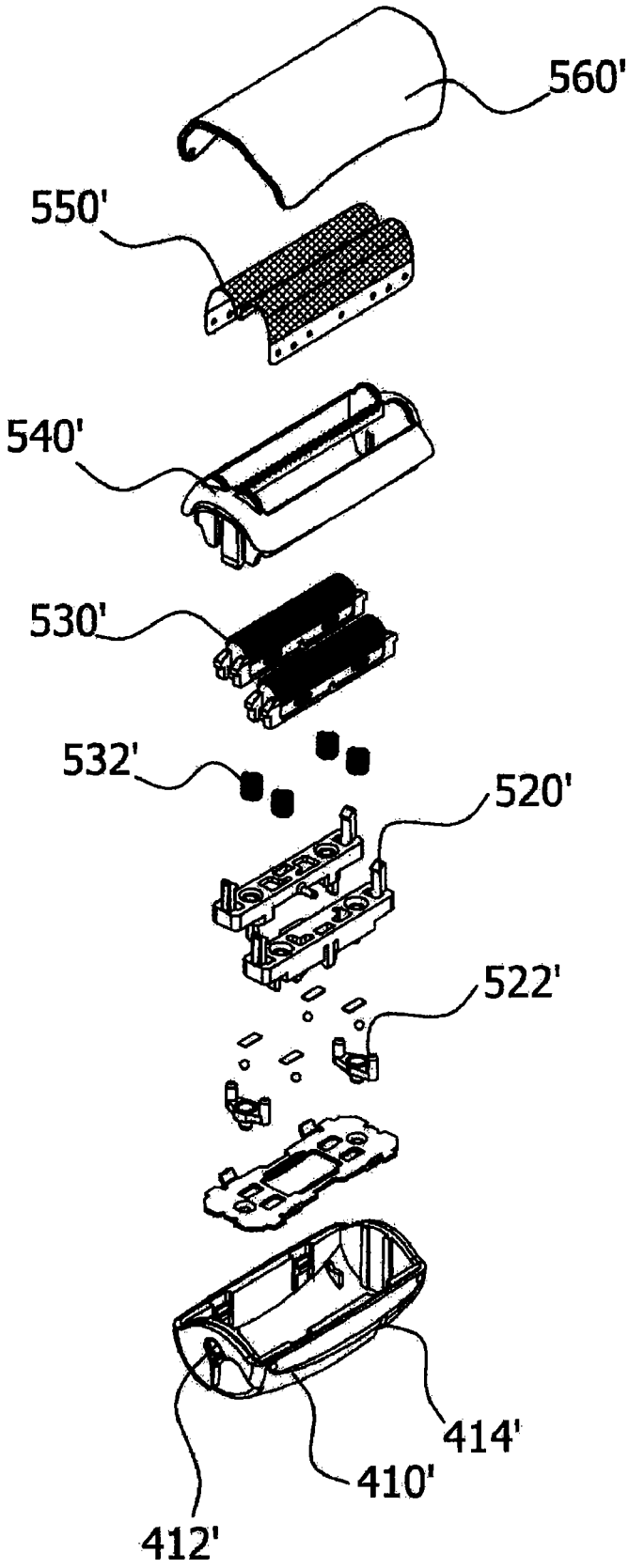
FIG. 4 is an exploded perspective view showing essential components of another preferred embodiment of a shave head.
Figure 5:
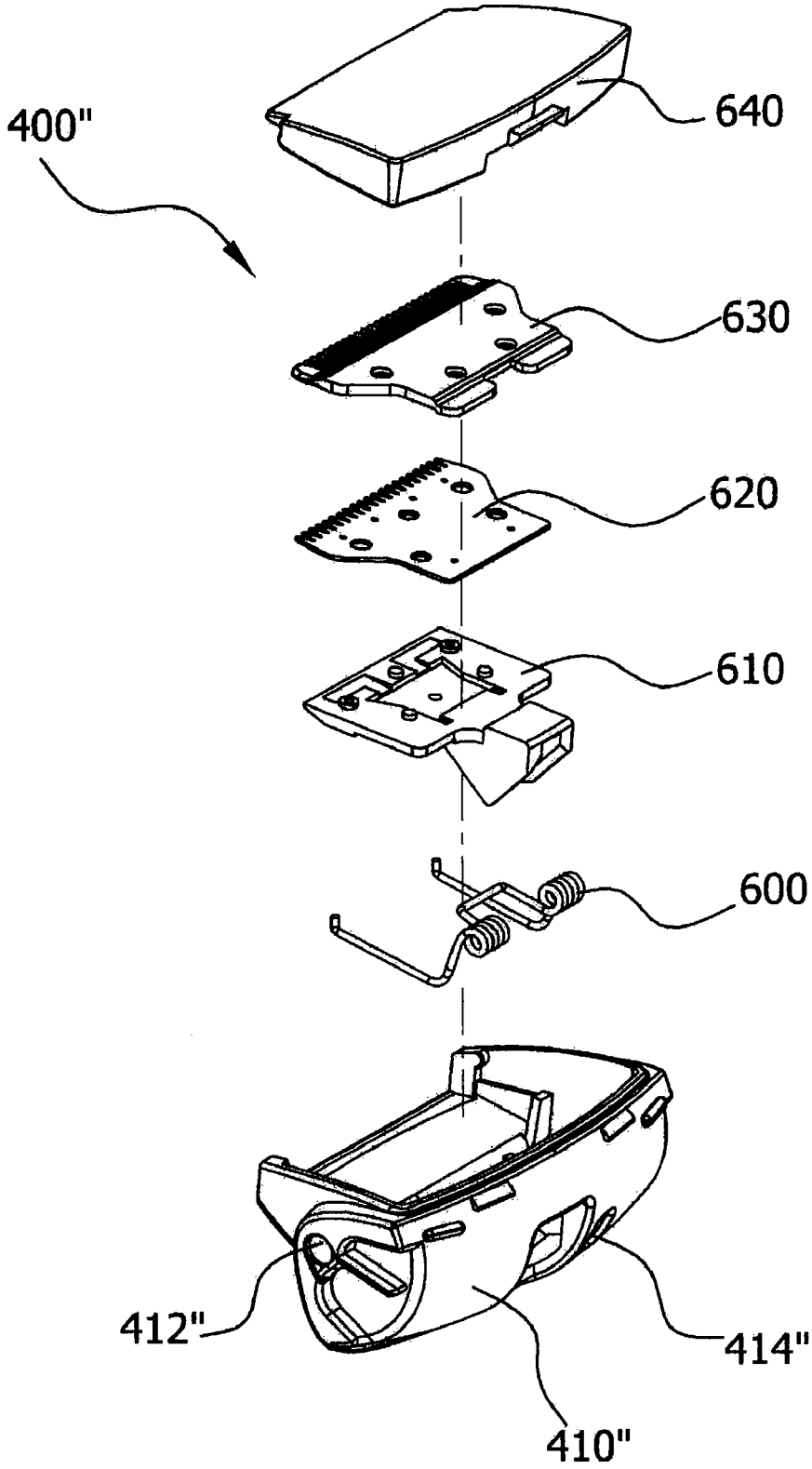
FIG. 5 is an exploded perspective view showing essential components of a trimmer head.
Figure 6:
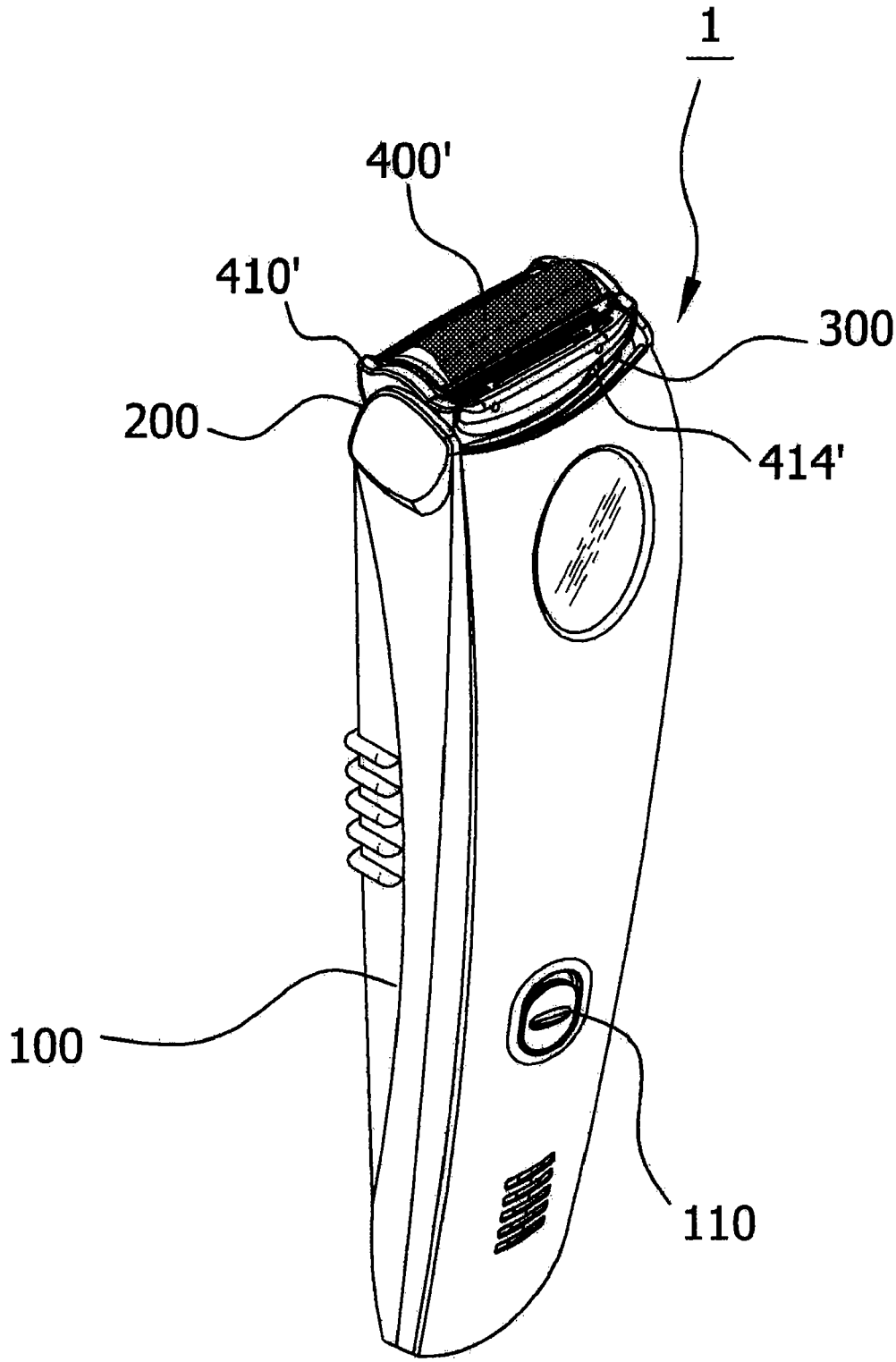
FIG. 6 is a perspective view showing a structure of mounting a shave head to a housing.
Figure 7:
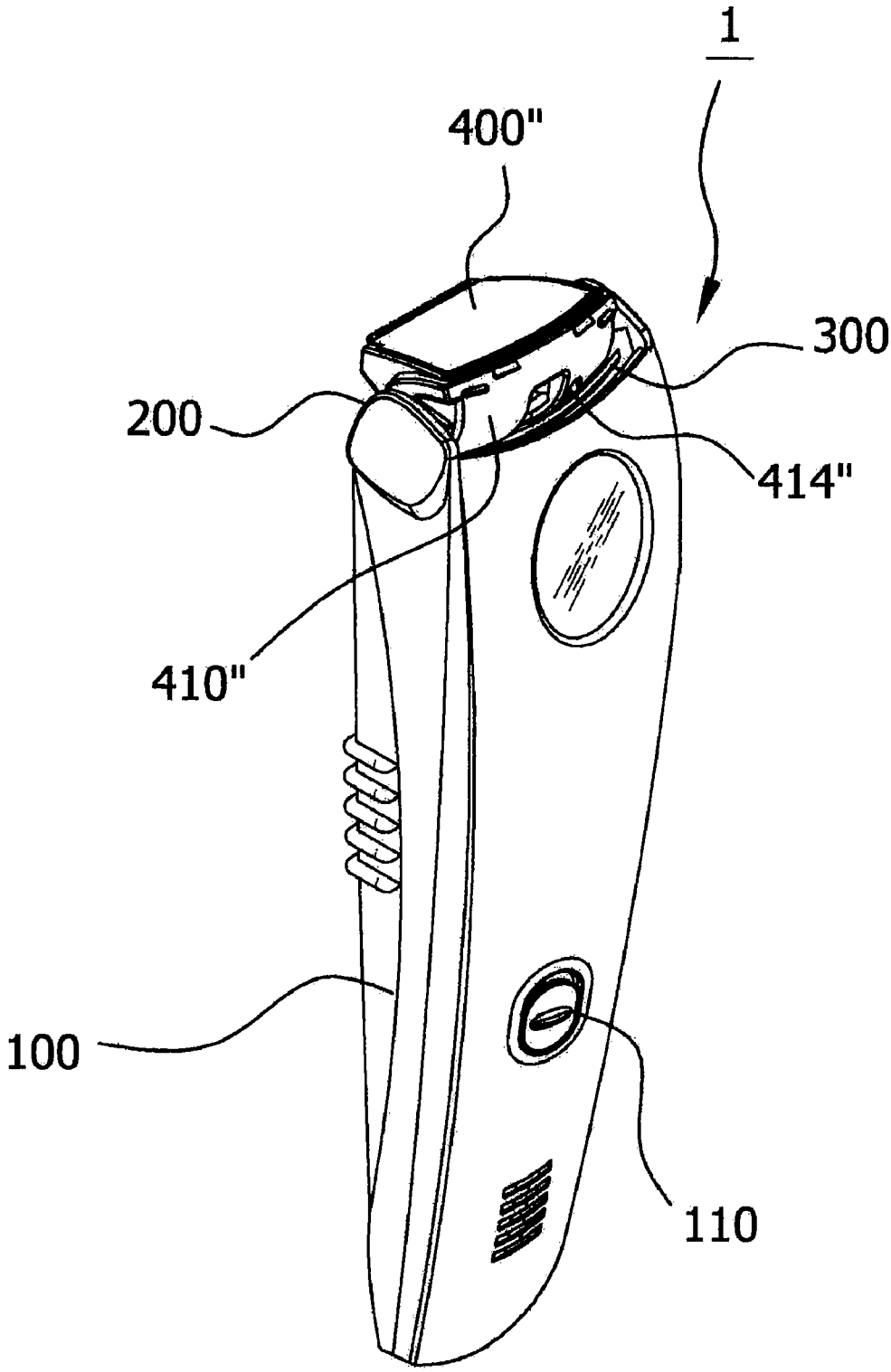
FIG. 7 is a perspective view showing a structure of mounting a trimmer head to a housing.
Figure 8:
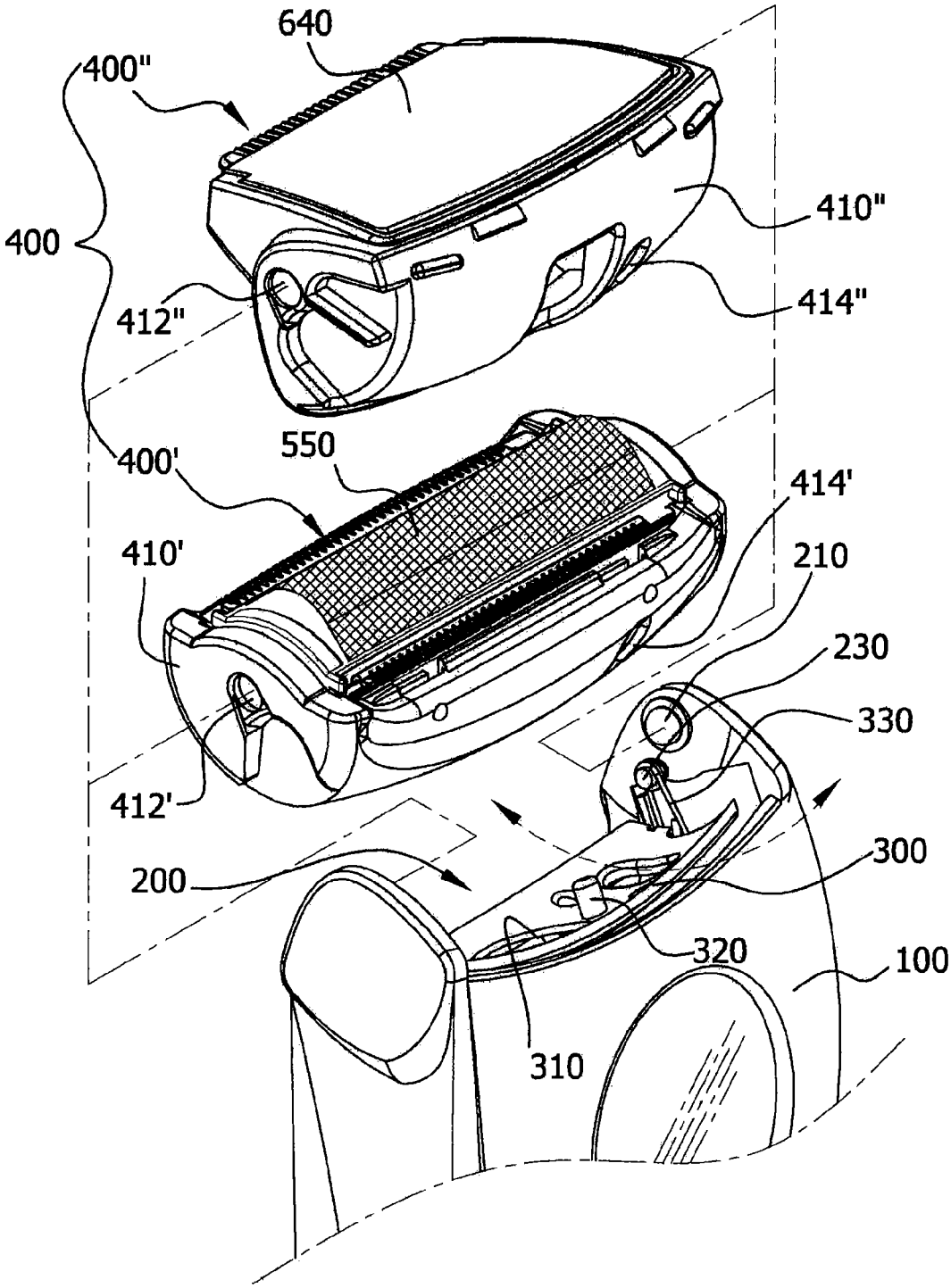
FIG. 8 is a perspective view showing essential components of a multi type head moving shaver in accordance with a preferred embodiment of the present invention.
Figure 9:
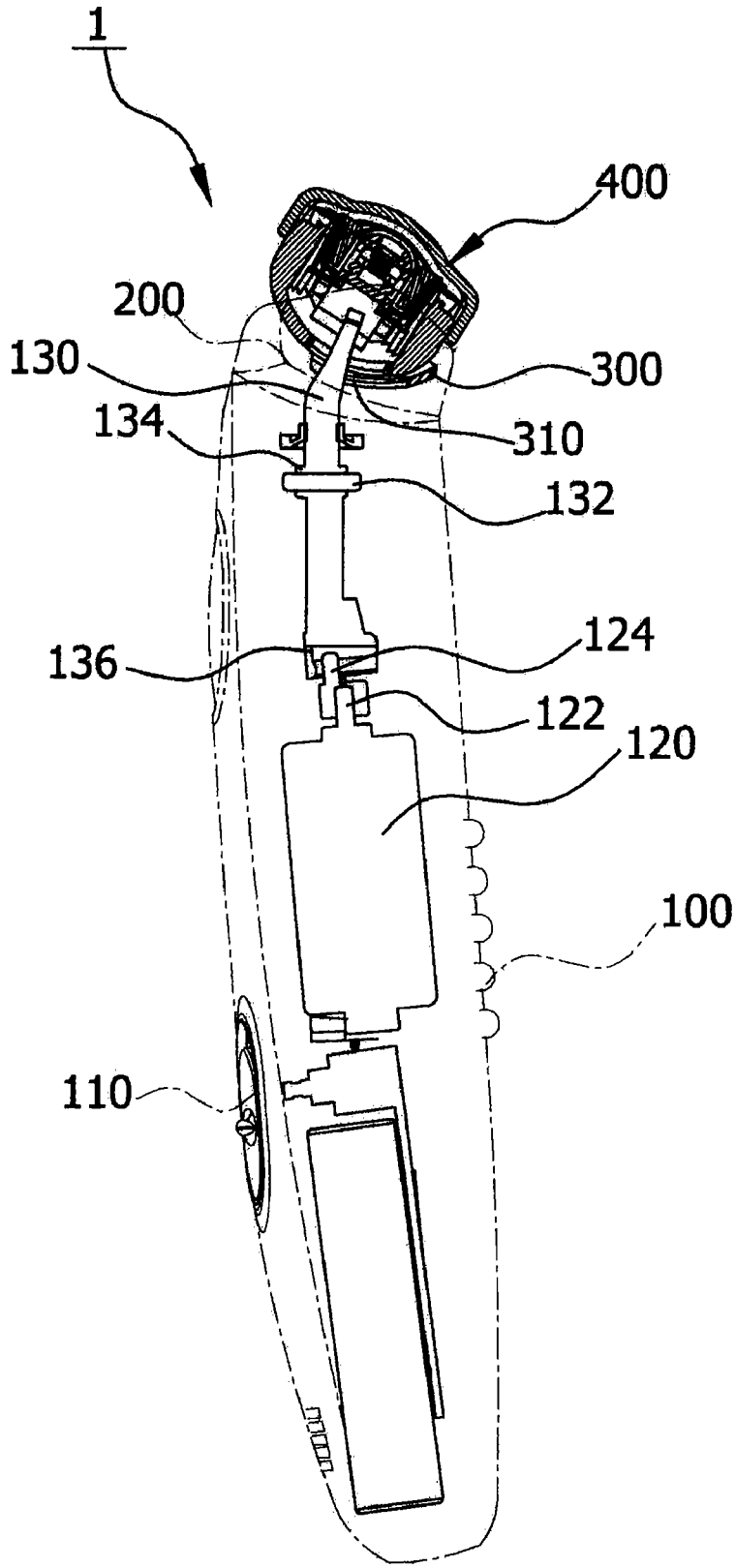
FIG. 9 is a side cross sectional view showing a multi type head moving shaver in accordance with a preferred embodiment of the present invention.
Figure 10:
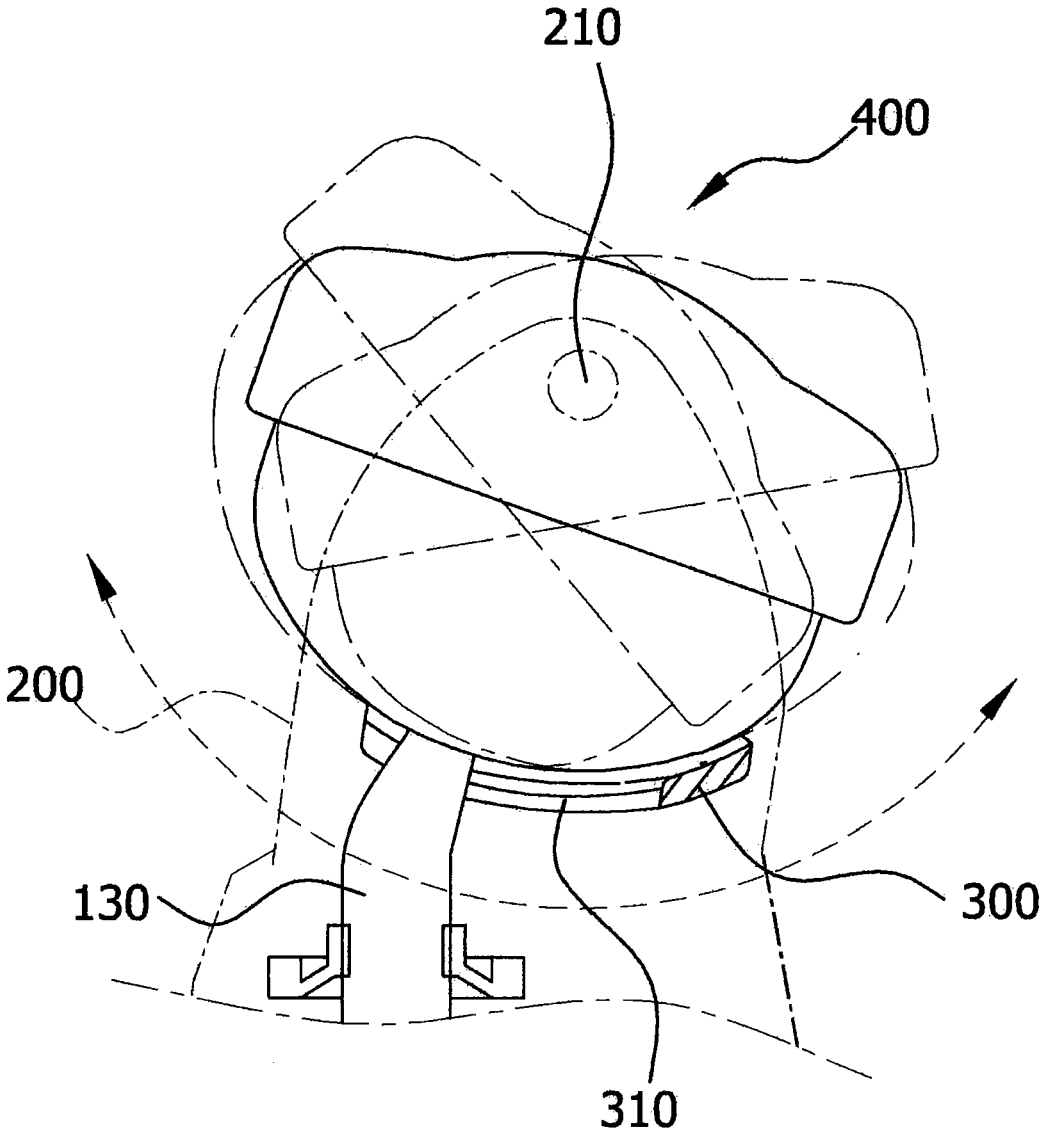
FIG. 10 is a view showing an operating state of a multi type head moving shaver in accordance with a preferred embodiment of the present invention.

FIG. 1 is a side view showing a multi type head moving shaver in accordance with a preferred embodiment of the present invention, FIG. 2 is an exploded perspective view showing a multi type head moving shaver in accordance with a preferred embodiment of the present invention, FIG. 3 is an exploded perspective view showing essential components of a preferred embodiment of a shave head, FIG. 4 is an exploded perspective view showing essential components of another preferred embodiment of a shave head, FIG. 5 is an exploded perspective view showing essential components of a trimmer head, FIG. 6 is a perspective view showing a structure of mounting a shave head to a housing, FIG. 7 is a perspective view showing a structure of mounting a trimmer head to a housing, FIG. 8 is a perspective view showing essential components of a multi type head moving shaver in accordance with a preferred embodiment of the present invention, FIG. 9 is a side cross sectional view showing a multi type head moving shaver in accordance with a preferred embodiment of the present invention, and FIG. 10 is a view showing an operating state of a multi type head moving shaver in accordance with a preferred embodiment of the present invention.

As shown in FIGS. 1 and 2, a multi type head moving shaver 1 according to the present invention comprises a housing 100, a cutting head 400, and a coupling member 300 for mounting the cutting head 400 to the housing 100. The shaver is stored and charged in a typical power charging cradle 2.

An ON/OFF switch 110 is provided at a front surface of the housing 100. When power is applied to a driving motor 120 by manipulating the ON/OFF switch 110, the driving motor 120 drives a connecting rod 130.

An inserting portion 200 is formed at the top of the housing 100, into which the cutting head 400 is inserted. An inserting hole 220 is formed at the center portion of the inserting portion 200. Pivot shafts 210 and supporting shafts 230 are formed at the inner surfaces of the both sides of the inserting portion 200. The pivot shaft 210 is a control point for pivoting a cutting head block 410 forward and backward within a predetermined range. The inserting hole 220 provides a space where the connecting rod 130 can be driven by the driving motor 120. The supporting shafts 230 support the coupling member 300. Springs 330 are provided at the supporting shafts 230 to support the coupling member 300 elastically.

The cutting head 400 is mounted onto the coupling member 300. The coupling member 300 is received in the inserting portion 200, and can pivot forward and backward by the elastic force of the springs 330 provided at the supporting shafts 230. Preferably, the spring 330 is a torsional spring.

A through-hole 310 is formed at the center portion of the coupling member 300. The through-hole 310 is positioned corresponding to the inserting hole 220 of the inserting portion 200 so that the connecting rod 130 can pass through the inserting hole 220 and the through-hole 310 and an interference is eliminated when the connecting rod 130 is driven. A supporting protrusion 320 is formed at a front surface of the coupling member 300, to which the cutting head 400 is jointed.

The cutting head 400 removes the hair from a user's face or body by cutting the same. According to the purpose of use, a shave head 400' and a trimmer head 400" are used selectively as the cutting head 400. The shave head 400' is used for cutting relatively short hair like a short beard or a mustache, and the trimmer head 400" is used for cutting relatively long hair like a long beard.

As shown in FIG. 3, the shave head 400' comprises a block 410' formed with concave portions 412' and coupling hole 414'. The pivot shafts 210 of the inserting portion 200 are fitted in the concave portions 412'. The supporting protrusion 320 of the coupling member 300 is fitted in the coupling hole 414'.

A shave fixing blade 500 having a first through-hole 502 is provided inside the block 410'. A shave moving blade 510 having a second through-hole 512 is provided on the shave fixing blade 500. The second through-hole 512 of the shave moving blade 510 is located corresponding to the first through-hole 502 of the shave fixing blade 500.

An inner blade holder 520 is positioned on the shave moving blade 510. The inner blade holder 520 includes an upper flat plate and a vibrator 522 formed under the upper plate. The vibrator 522 passes through the first through-hole 502 and the second through-hole 512. The vibrator 522 is connected to the coupling rod 130 to vibrate left and right.

An inner blade 530 is mounted onto the holder 520. Coil springs 532 are provided near the both side ends between the holder 520 and the inner blade 530 to absorb a pressure due to a pressurizing force when shaving.

An outer blade frame 540 is coupled onto the block 410', and a mesh-shaped outer blade 550 is attached onto the frame 540 over the inner blade 530. When shaving, the mesh-shaped outer blade 550 contacts directly to the user's skin. A cover 560 is detachably coupled to the outer blade 550 to prevent inflow of foreign materials and damage of the outer blade 550.

By the structure described above, when power is applied to the driving motor by manipulating the ON/OFF switch, the driving motor drives the connecting rod to move reciprocatingly. The vibrator mounted in the cutting head moves reciprocatingly together with the connecting rod. Accordingly, the moving blade and the inner blade also move reciprocatingly in the cutting head to cut the hair inserted through the holes of the mesh-shaped outer blade, to thereby achieve a clean shaving.

As shown in FIG. 4, it is preferable to provide inner blades 530', inner blade holders 520' and vibrators 522' by pairs, respectively. It is also preferable to form the shapes of an outer blade frame 540', a mesh-shaped outer blade 550' and a cover 560' according to the shape of the inner blades 530'.

As shown in FIG. 5, the trimmer head 400" comprises a block 410" formed with concave portions 412" and coupling hole 414". The pivot shafts 210 of the inserting portion 200 are fitted in the concave portions 412". The supporting protrusion 320 of the coupling member 300 is fixed in the coupling hole 414".

A holder 610 for supporting a trimmer moving blade 620 is seated in the block 410". A torsional coil spring 600 is interposed between the block 410" and the holder 610 so as to prevent the separation of the holder 610 from the block 410" and keep a gap uniform between the block 410" and the holder 610.

The trimmer moving blade 620 is mounted onto the holder 610, and moves left and right recriprocatingly. A trimmer fixing blade 630 is mounted onto the trimmer moving blade 620. The trimmer fixing blade 630 cuts the relatively long hair by the interaction with the trimmer moving blade 620 which moves left and right reciprocatingly. A holder 640 for supporting the trimmer fixing blade 630 is positioned on the runner fixing blade 630, and coupled to the block 410.

As shown in FIGS. 6 and 7, the shave head 400' and the trimmer head 400" can be used selectively as the cutting head 400 according to the purpose of use.

As shown in FIG. 9, a supporting piece 134 is provided in the housing 100. A pivot 132 is mounted to the supporting piece 134. The connecting rod 130 is connected to the pivot 132. The upper end of the connecting rod 130 passes through the inserting hole 220 of the inserting portion 200 and the through-hole 310 of the coupling member 300, and is slidably coupled to the cutting head 400.

A clevis 136 is formed at the lower end of the connecting rod 130. An eccentric shaft 124 is coupled to a motor shaft 112 of the driving motor 120, and is slidably inserted into the clevis 136.

Hereinafter, the operational effect of the present invention will be described.

As shown in FIGS. 8 and 9, a coupling member 300 is coupled to the inserting portion 200 formed at the top of the housing 100. The coupling member 300 is elastically supported by the torsional springs 330 provided at the supporting shafts 230 formed at the both sides of the inserting portion 200.

When an external force is applied to the coupling member 300, the coupling member 300 pivots forward and backward within a predetermined range by the elastic force of the torsional springs 330. The inserting hole 220 of the inserting portion 200 is positioned corresponding to the through-hole 310 of the coupling member 300. Then, the cutting head 400 is mounted to the coupling member 300.

First Embodiment

When the user intends to cut the relatively short hair, the user fits the shave head 400' into the inserting portion 200 so that the pivot shafts 210 are inserted into the concave portions 412' of the shave head block 410' and the supporting protrusion 320 of the coupling member 300 is inserted into the coupling hole 414' of the shave head block 410'.

If power is applied to the driving motor 120 by manipulating the ON/OFF switch 110, the driving motor 120 operates. The rotating force of the motor shaft 122 of the driving motor 120 is transmitted to the eccentric shaft 124 to rotate the same.

While rotating in the clevis 136, the eccentric shaft 124 moves the connecting rod 130 reciprocatingly. The connecting rod 130 connected to the pivot 132 mounted to the supporting piece 134 extends through the inserting hole 220 of the inserting portion 200 and the through-hole 310 of the coupling member 300. The vibrator 522 in the block 410' of the shave head 400' is connected to the top of the connecting rod 130.

Accordingly, the connecting rod 130 and the vibrator 522 move together left and right reciprocatingly on the pivot 132, and the shave moving blade 510 and the inner blade 530 also move left and right reciprocatingly to cut the relatively short hair.

Second Embodiment

When the user intends to cut the relatively long hair, the user fits the trimmer head 400" into the inserting portion 200 so that the pivot shafts 210 are inserted into the concave portions 412" of the trimmer head block 410" and the supporting protrusion 320 of the coupling member 300 is inserted into the coupling hole 414" of the trimmer head block 410". Since the operation of the trimmer head 400" is same as that of the shave head 400', the detailed description will be omitted.

If the driving motor 120 operates, the connecting rod 130 moves left and right reciprocatingly. The trimmer moving blade holder 610 in the trimmer head block 410", which is connected to the top of the connecting rod 130, also moves left and right reciprocatingly. Therefore, the trimmer moving blade 620 cuts the relatively long hair.

As shown in FIG. 10, the coupling member 300 and the cutting head 400 (the shave head 400' or the trimmer head 400") pivot together on the pivot shafts 210 of the inserting portion 200 within a predetermined range. As a result, the cutting head 400 can smoothly follow the curve of the user's face or body, and the shaver can be manufactured compactly to improve portability and function.

As apparent from the above description, the present invention provides a multi type head moving shaver capable of selectively mounting the shave head and the trimmer head.

The multi type head moving shaver has a simple structure and achieves a smooth and perfect shaving by pivoting the shave head or the trimmer head forward and backward to follow a curve of a user's face or body.

The multi type head moving shaver can be manufactured compact to improve portability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A multi type head moving shaver, comprising:

a housing provided with an ON/OFF switch and an inserting portion formed at a top of the housing;

a connecting rod mounted inside the housing, the connecting rod being driven by a driving motor;

a coupling member coupled to the inserting portion, the coupling member pivoting forward and backward; and a cutting head having a block coupled onto the coupling member, the cutting head pivoting together with the coupling member, wherein the inserting portion includes an inserting hole formed at a center portion, the connecting rod passing through the inserting hole; supporting shafts formed at left and right sides of the inserting hole; springs provided at the supporting shafts, the springs elastically supporting the coupling member pivoting forward and backward on the supporting shafts; and pivot shafts formed at the left and right sides of the inserting hole, the cutting head pivoting on the pivot shafts, wherein the coupling member includes a through-hole formed at a center portion, the through-hole being located corresponding to the inserting hole of the inserting portion; and a supporting protrusion to which the cutting head is coupled, and wherein the block of the cutting head includes concave portions into which the pivot shafts are fitted, and a coupling hole into which the supporting protrusion is fitted.

2. The multi type head moving shaver according to claim 1, wherein the cutting head is a shave head.

3. The multi type head moving shaver according to claim 2, wherein at least one inner blade is provided in the shave head.

4. The multi type head moving shaver according to claim 1, wherein the cutting head is a trimmer head.

5. The multi type head moving shaver according to claim 1, wherein a shave head and a trimmer head are mounted selectively to the housing as the cutting head.

* * * * *